US005502287A

United States Patent [19]

Nguyen

[11] Patent Number: 5,502,287

[45] Date of Patent: Mar. 26, 1996

[54] MULTI-COMPONENT CABLE ASSEMBLY

[75] Inventor: Phu D. Nguyen, San Jose, Calif.

[73] Assignee: Raychem Corporation, Menlo Park, Calif.

[21] Appl. No.: 28,710

[22] Filed: Mar. 10, 1993

[51] Int. Cl.[6] ..... H01B 7/00

[52] U.S. Cl. ..... 174/113 R; 156/53; 174/117 A; 174/128.2; 174/255; 174/259

[58] Field of Search ..... 174/113 R, 255, 174/259, 110 R, 113 A, 117 R, 117 F, 117 M, 117 A, 128.1, 128.2, 129 R, 72 R, 72 A, 72 TR; 156/51, 52, 53, 54, 55

[56] References Cited

U.S. PATENT DOCUMENTS

| | | | |
|---|---|---|---|
| 3,613,230 | 10/1971 | Griff | 29/624 R |
| 3,653,121 | 4/1972 | Moriyama et al. | 29/604 |
| 3,733,428 | 5/1973 | Fry | 174/72 A |
| 3,745,230 | 7/1973 | Kelly | 174/103 |
| 3,819,848 | 6/1974 | Fry | 174/72 A |
| 4,000,348 | 12/1976 | Harlow | 428/422 |
| 4,012,577 | 3/1977 | Lang et al. | 174/27 |
| 4,045,750 | 8/1977 | Marshall | 333/6 |
| 4,093,480 | 6/1978 | Blalock et al. | 156/54 |
| 4,113,335 | 9/1978 | Lang et al. | 339/29 R |
| 4,138,193 | 2/1979 | Olszewski et al. | 174/117 F X |
| 4,157,452 | 6/1979 | Pignataro et al. | 174/36 |
| 4,165,559 | 8/1979 | Lang et al. | 29/629 |
| 4,183,010 | 1/1980 | Miller | 367/154 |
| 4,468,089 | 8/1984 | Brorein | 350/96.23 |
| 4,478,778 | 10/1984 | Look | 264/146 |
| 4,486,619 | 12/1984 | Trine et al. | 174/34 |
| 4,501,929 | 2/1985 | Escallier et al. | 174/117 F |
| 4,538,024 | 8/1985 | Wise et al. | 174/117 F |
| 4,548,661 | 10/1985 | Escallier et al. | 156/52 |
| 4,616,717 | 10/1986 | Luetzow | 174/117 F |
| 4,625,074 | 11/1986 | Cox | 174/117 F |
| 4,626,298 | 12/1986 | Allard | 156/55 |
| 4,639,693 | 1/1987 | Suzuki et al. | 333/1 |
| 4,678,709 | 7/1987 | Tondre et al. | 428/380 |
| 4,678,864 | 7/1987 | Cox | 174/36 |
| 4,711,811 | 12/1987 | Randa | 428/383 |
| 4,715,677 | 12/1987 | Saito et al. | 350/96.23 |
| 4,767,891 | 8/1988 | Biegon et al. | 174/34 |
| 4,783,578 | 11/1988 | Bodensiek et al. | 174/117 F |
| 4,900,126 | 2/1990 | Jackson et al. | 350/46.23 |
| 4,926,007 | 5/1990 | Aufderheide et al. | 174/36 |
| 4,974,798 | 12/1990 | Harding et al. | 248/73 |
| 5,010,642 | 4/1991 | Takahashi et al. | 29/868 |
| 5,030,794 | 7/1991 | Schell et al. | 174/36 |
| 5,111,102 | 5/1992 | Hollander | 174/102 P |
| 5,268,531 | 12/1993 | Nguyen et al. | 174/36 |
| 5,276,579 | 1/1994 | Nguyen et al. | 385/114 |
| 5,278,356 | 1/1994 | Miller | 174/117 A |

FOREIGN PATENT DOCUMENTS

| | | | |
|---|---|---|---|
| 652787 | 12/1964 | Belgium | H01B 13/00 |
| 0257855 | 2/1988 | European Pat. Off. | H01B 11/08 |
| 2036798 | 12/1970 | France | H01B 13/00 |
| 2457548 | 12/1980 | France | H01B 13/00 |
| 2516294 | 5/1983 | France | H01B 7/08 |
| 1417209 | 12/1975 | United Kingdom | H01B 13/00 |
| 2058439 | 8/1981 | United Kingdom | H01B 7/08 |

*Primary Examiner*—Morris H. Nimmo
*Assistant Examiner*—Christopher Horgan
*Attorney, Agent, or Firm*—Timothy H. P. Richardson; Sheri M. Novack; Herbert G. Burkard

[57] ABSTRACT

This invention relates to multi-component assemblies comprising a plurality of substantially parallel insulated conductors and or cables at least one of which is wrapped in a flexible affixment means thereby enabling the wrapped component to be secured to a support substrate.

24 Claims, 7 Drawing Sheets

MULTI-COMPONENT CABLE ASSEMBLY

BACKGROUND OF THE INVENTION

This invention relates to multi-component assemblies and in particular multi-component cable assemblies comprising one or more insulated conductors mounted on a substrate which comprises a polymeric material.

A common method of organizing insulated conductors is by forming them into flat cables, which can take several forms. In one form of flat cable a plurality of conductors are placed parallel to one another and are laminated between a pair of films which surround each conductor thereby insulating each conductor from its neighbors as well as forming the flat cable construction. Another form of flat cable, uses pre-insulated conductors bonded to a carrier film. The film is generally of a polymeric material similar to that of the insulation and in order to achieve a bond between the insulated conductors and the film, the film is often heated to about its melting point. However, with certain types of insulation, it is difficult if not impossible to secure the insulated conductor to the film without chemical pretreatment of the insulation to enhance its adhesability (for example, with polytetrafluoroethylene or polysiloxane insulated conductors). Recently, it has been realized that flat cable construction techniques could be used to organize, not just groups of single insulated conductors but also groups of multiconductor cables or mixed multiconductor and single conductor cables. It has been proposed to use, for example, such organized bundles of cables to route high fidelity sound and video signals to each seat in new generations of commercial aircraft so that each passenger can view a desired program on a personal television screen (placed, for example, in the back of the seat in front). However to facilitate attachment of multiconductor bundles to the carrier film, hitherto it has been found necessary to contain the bundle in an extruded jacket which is then secured to the carrier film. Such constructions have the disadvantage that the outer jacket adds weight to the assembly and makes the bundles and especially the flat cable construction very stiff and difficult to bend without excessive distortion or even failure of the carrier film especially when the bundle contains more than two or so individual conductors.

This application is related to copending, commonly assigned, United States application Ser. No. 07/847,558, filed Mar. 6, 1992, now U.S. Pat. No. 5,268,531, and to copending, commonly assigned, U.S. application Ser. No. 07/890,045, filed May 28, 1992, now U.S. Pat. No. 5,327,513.

OBJECTS AND SUMMARY OF THE INVENTION

It is an object of this invention to provide multi-component assemblies having a means for the securing of low surface energy insulations to a support substrate such as a carrier film. Another object of this invention is to provide multi-component cable assemblies in which groups of insulated conductors are wrapped with an affixment means whereby they may be secured to a support substrate such as a carrier film together with a method for providing such multi-component cable assemblies. Yet another object of this invention is to provide multi-component cable assemblies, in which individual insulated conductors or groups of conductors are slidably wrapped in an affixment means which is secured to a support substrate such as a carrier film so that the assemblies may be bent or twisted without undue distortion of or stress to the carrier film of the affixment means, together with a method for providing such multi-component cable assemblies.

This invention provides a flexible multi-component cable assembly comprising conductors having low energy insulations and/or multiconductor cables secured to a support substrate.

A first aspect of this invention provides a multi-component cable assembly comprising:

a planar support substrate;

at least one cable component which comprises one or more cables and/or insulated conductors;

the cable component being wrapped with a flexible affixment means; and the flexible affixment means being secured to the support substrate.

A second aspect of this invention comprises a multi-component cable assembly comprising two or more cable components secured to a flexible tubular cover wherein, if the cable components are brought into planar alignment with each other by flattening the tubular cover in a direction transverse to a longitudinal axis thereof, such that the tubular cover has a first major interior surface opposed to a second major interior surface, all the cable components are secured to the first interior surface of the flattened tubular cover.

A third aspect of this invention comprises a multi-component cable assembly comprising a first cable component, and a second cable component, secured to a flexible tubular cover wherein, if the cable components are brought into planar alignment with each other by flattening the tubular cover in a direction transverse to a longitudinal axis thereof, such that the tubular cover has a first major interior surface opposed to a second major interior surface, the first cable component is secured to the first interior surface of the flattened tubular cover and the second cable component is secured to the second interior surface of the flattened tubular cover.

A fourth aspect of this invention provides a multi-component cable assembly comprising a first cable component, and a second cable component, secured to a flexible flattened tubular cover which is flattened in a direction transverse to a longitudinal axis thereof, such that the tubular cover has a first major interior surface opposed to a second major interior surface, the cable components being substantially in planar alignment with each other and wherein, the first cable component is secured to to the first interior surface of the flattened tubular cover and the second cable component is secured to the second interior surface of the flattened tubular cover.

A fifth aspect of this invention comprises a multi-component cable assembly comprising a first cable component, a second cable component and a third cable component, secured to a flexible tubular cover wherein, if the cable components are brought into planar alignment with each other by flattening the tubular cover in a direction transverse to a longitudinal axis thereof, such that the tubular cover has a first major interior surface opposed to a second major interior surface, the first and the second cable components are secured to the first interior surface of the flattened tubular cover and the third cable component is secured to the second interior surface of the flattened tubular cover.

A sixth aspect of the invention provides a multi-component cable assembly comprising a first cable component, a second cable component and a third cable component, secured to a flat support substrate that is folded along a longitudinal axis between and substantially parallel to the three cable components to form a tubular cover comprising a first major interior surface opposing a second major interior surface, the first major surface having the first cable component and the second cable component secured thereto and the second major surface having the third cable component secured thereto, the third cable component thereby occupying a position between the first cable component and the second cable component.

A seventh aspect of this invention comprises a method of making a multi-component cable assembly comprising:

1) providing at least one cable component;

2) wrapping the cable component in a flexible affixment means to form a wrapped cable component;

3) securing the flexible affixment means to a support substrate.

A eighth aspect of the invention provides a multi-component cable assembly produced by the method of the fifth aspect of the invention.

DETAILED DESCRIPTION OF THE INVENTION

Figure 1A:
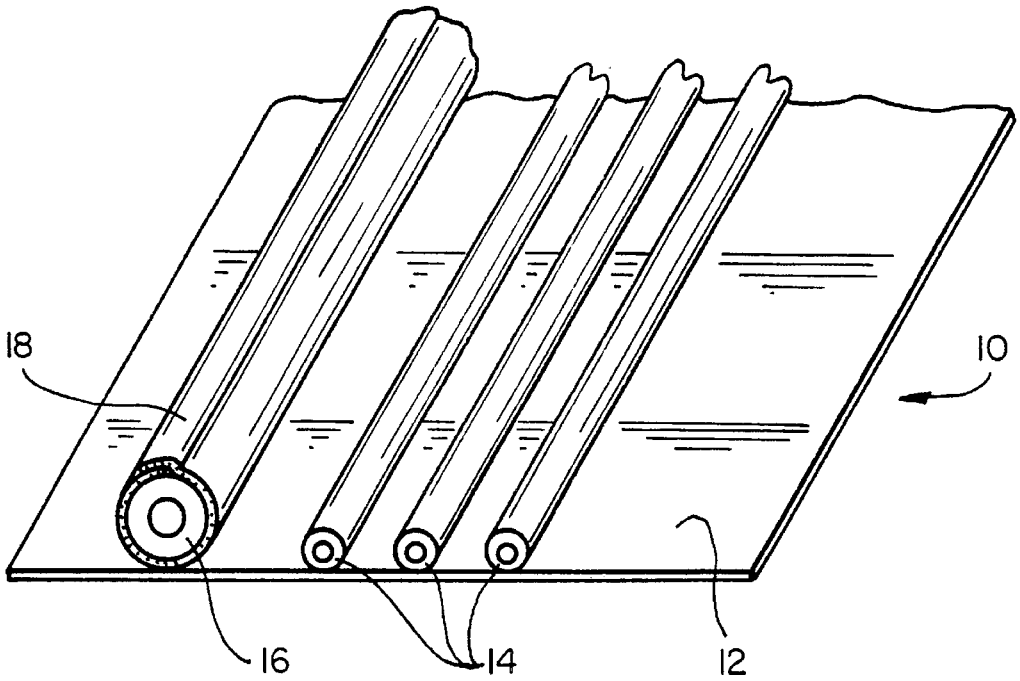
FIGS. 1*a* and 1*b* illustrate multi-component cable assemblies of this invention wrapped in a flexible affixment means that is secured to a support substrate.

The term affixment means contemplates any means for physically attaching a component to a support substrate without a direct bond, for example an adhesive bond, being formed between the component and the support substrate.

In certain preferred embodiments of the first aspect of the invention, the cable components can move within the affixment means to accommodate stresses due to twisting or deformation of the multi-component assembly. Such movement, for example, may be longitudinal and/or through the components twisting or bending. In another preferred embodiment of this aspect of the invention, the support substrate, optionally in the form of a film, comprises a first in plane dimension and a second in-plane dimension, with a first edge region and a second edge region being located at opposite ends of the first dimension, the affixment means being secured along the second dimension of the support film; and the first edge region and the second edge regions of the support substrate being folded over the at least one cable component comprising a flexible affixment means and secured to one another to form a tubular cover for the multi-component cable assembly.

In other preferred embodiments of the first aspect of the invention the support substrate comprises a dimension transverse to the orientation of a multi-component cable and comprises a first edge region and a second edge region at opposite ends of the dimension, the first edge region and the second edge regions of the support substrate having been folded over the at least one cable component to form a tubular cover for the multi-component cable assembly. Some of these embodiments have two or more cable components secured to a flexible flat tubular cover which is flat in a direction transverse to a longitudinal axis thereof, such that the tubular cover has a first major interior surface opposed to a second major interior surface, and all the cable components are secured to the first interior surface of the flattened tubular cover. Others of these embodiments comprise at least two cable components, at least one of which comprises a flexible affixment means, and the support means has been folded along a longitudinal axis between and substantially parallel to the two cable components to form a flat tubular cover comprising a first major interior surface opposing a second major interior surface, the first major surface having the first cable component secured thereto and the second major surface having the second cable component secured thereto.

In certain preferred embodiments of the second aspect of the invention the multi-component cable assembly comprises at least two cable components, at least one of which comprises a flexible affixment means. More preferably the multi-component cable assembly comprises at least one multi-conductor cable component.

In certain preferred embodiments of the third, fourth, fifth and sixth aspects of the invention the multi-component cable assembly comprises at least two cable components, at least one of which comprises a flexible affixment means, and the tubular cover has been formed by folding a support substrate, to which the cable components and/or at least one flexible affixment means have been secured, along a longitudinal axis between and substantially parallel to the two cable components to form the tubular cover and flattened so that the tubular cover comprises a first major interior surface opposing a second major interior surface, such that the first major surface has the the first cable component secured thereto and the second major surface has the second cable component secured thereto. Preferably the support substrate comprises a first in plane dimension and a second in-plane dimension, and comprises a first edge region and a second edge region at opposite ends of the first dimension, and, in forming the tubular cover, the first edge region and the second edge region of the support substrate are secured together.

In other preferred embodiments of the the third, fourth, fifth and sixth aspects of the invention the multi-component cable assembly comprises a first cable component, a second cable component and a third cable component, at least one of which comprises a flexible affixment means, and the tubular cover has been formed by folding a support substrate, to which the cable components and/or at least one flexible affixment means have been secured, along a longitudinal axis between and substantially parallel to the three cable components to form the tubular cover that, if flattened to form a first major interior surface thereof opposing a second major interior surface thereof, then the first major surface has the first cable component and the second cable component secured thereto and the second major surface has the third cable component secured thereto such that the the third cable component occupies a position between the first cable component and the second cable component. In yet further preferred embodiments of these aspects of the invention at least one cable component is secured to the flexible tubular cover by a flexible affixment means wrapped around the cable component. In a particularly preferred embodiment of these aspects at least three of the cable components comprise a flexible affixment means. Preferably in embodiments of the second and third aspects of the invention, when the tubular cover is flattened, the first, third and second cable components can interdigitate.

Preferred embodiments of the first, second, third, fourth, fifth and sixth aspects of the invention use a flexible affixment means which is spirally wrapped around the cable component. Consecutive turns of the flexible spiral affixment means may overlap, although in many instances it will be preferred that consecutive turns of the flexible spiral affixment means be spatially separated from one another. In all these embodiments of the method of the invention, the cable component affixment means is preferably secured in the direction of a long axis of the support substrate. Preferably the affixment means is adhered to the support substrate. More preferably the affixment means is melt bonded to the support substrate.

In embodiments of the third, fourth, fifth and sixth aspects of the invention, when the multi-component cable is not flattened, each cable component independently has a diameter such that the largest transverse dimension of the multi-component cable assembly is less than the sum of the diameters of all the cable components. When the tubular cover of the multi-component cable assembly is flattened such that the various cable components are substantially coplanar, then each cable component independently has a diameter such that the largest transverse dimension of the multi-component cable assembly is equal to or greater than the sum of the diameters of all the cable components.

In particularly preferred embodiments of the seventh aspect of the invention, which is the method of the invention, the support substrate comprises a first edge region and a second edge region at opposite ends of a short dimension, and the method comprises the additional step of folding the support substrate along a long dimension such that the first edge region and the second edge region of the support substrate are aligned together, then securing the first edge region to the second edge region. Preferably the first and second edge regions are secured together by adhering one to the other. More preferably the first and second edge regions are melt bonded to each other.

In preferred embodiments of the method of the invention the step of wrapping with a flexible affixment means comprises wrapping a thin film around the cable component. In more preferred embodiments of the method of the invention the step of wrapping with a flexible affixment means comprises spirally wrapping a thin film around the cable component such that consecutive turns overlap. In other more preferred aspects of the method of the invention, the step of wrapping with a flexible affixment means comprises spirally wrapping a thin polymeric film around the cable component such that consecutive turns of the film are spatially separated from one another. In all these embodiments of the method of the invention, the at least one flexible affixment means is preferably secured to a long axis of the support substrate in the direction of the long axis of the support substrate. Preferably the step of securing the affixment means to the support substrate comprises the step of adhering the affixment means to the support substrate. More preferably the step of adhering comprises melt bonding the affixment means to the support substrate.

Figure 1B:
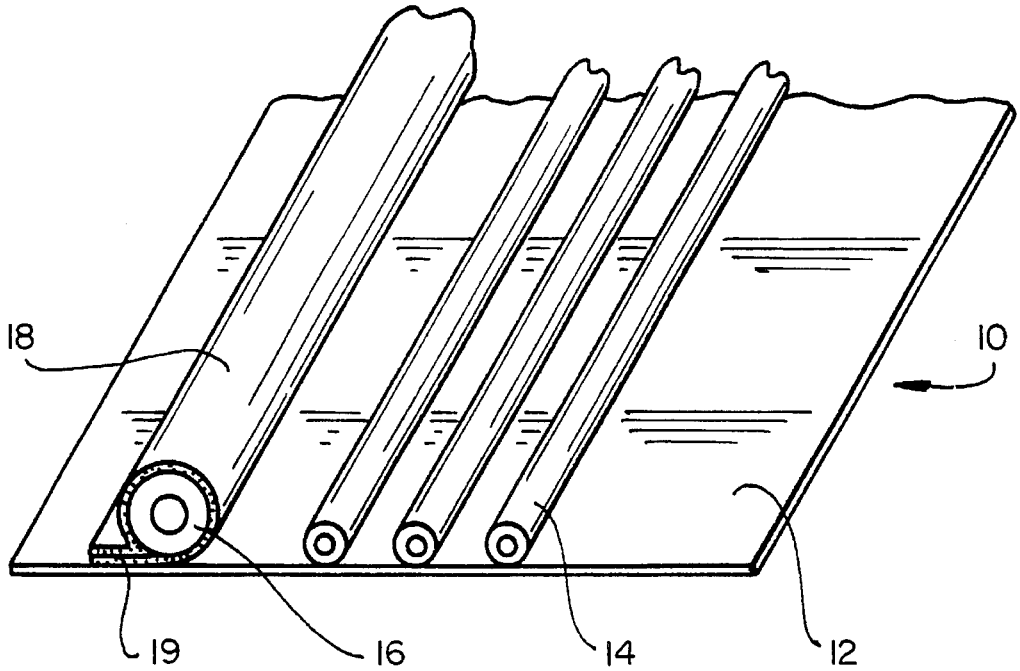

FIG. 1*a* illustrates a multi-component cable assembly of this invention in which each conductor comprises an insulated electrical conductor. In FIG. 1*a* a multi-component cable assembly 10 comprises a support substrate layer 12, and three individually insulated conductors 14 together with insulated conductor 16 in which the insulation manifests a low surface energy (that is, it is difficult to adhere to). Insulated conductor 16 has folded around it a flexible affixment means 18 whose overlapping ends are sealed to one another. The flexible affixment means is secured to the support substrate layer 12. In FIG. 1*b*, the first and second edge regions of a short dimension of the flexible affixment means 18 are brought together around the insulated conductor 16 and secured together 19 and to the support substrate layer 12 (advantageously by simultaneous melt bonding).

Figure 2:
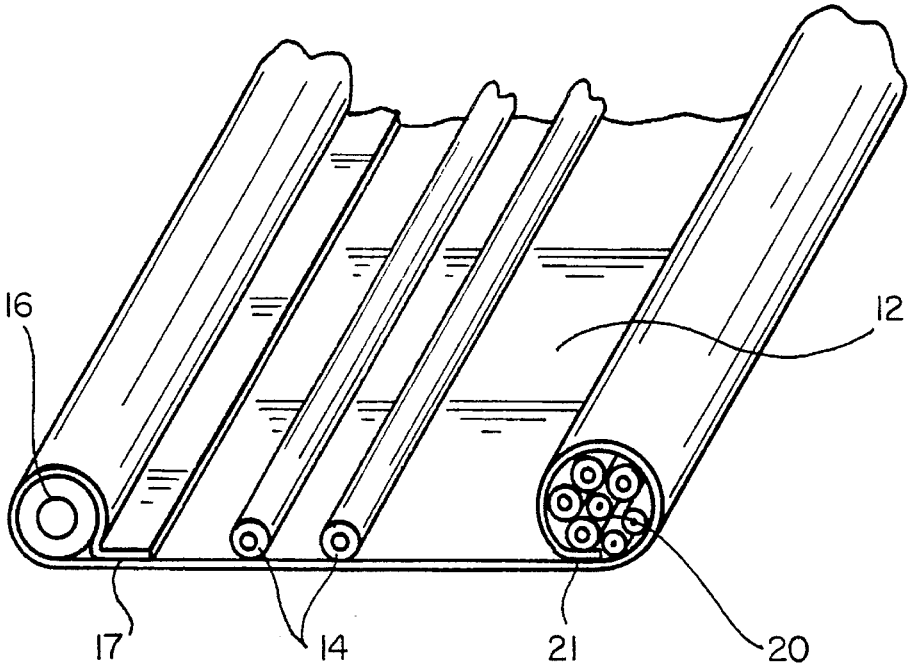
FIG. 2 shows an embodiment in which a support substrate layer edge regions are wrappped around two cable components to form a flexible affixment means, which is secured to a support substrate.

In FIG. 2 insulated conductor 16, in which the insulation manifests a low surface energy, has been placed near one edge of a support substrate film 12 which has been folded around the insulated conductor 16 and secured to itself 17. Thus in this embodiment the carrier film edge region serves as a flexible affixment means for the insulated conductor. Also in this figure, a bundle of insulated conductors 20 have been placed near to a second edge region of the support substrate film which has been folded around the cable bundle and secured to itself 21 so that this second support substrate edge region also serves as the flexible affixment means for the bundle of insulated conductors.

Figure 3A:
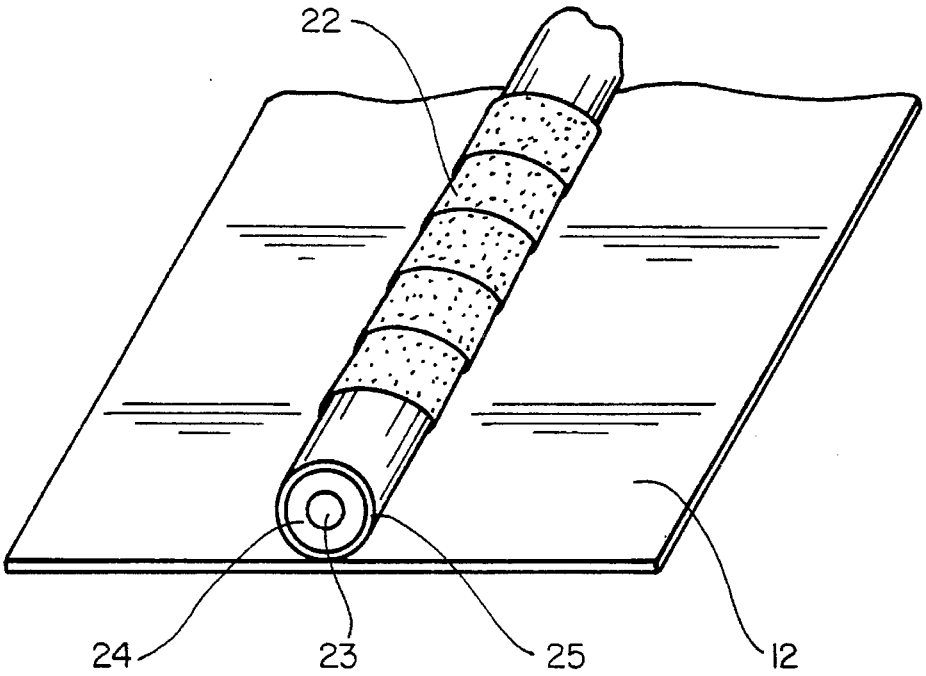
FIGS. 3*a*, 3*b* and 3*c* show various ways in which the flexible affixment means may be wrapped around an insulated conductor or a multi conductor cable.
Figure 3B:
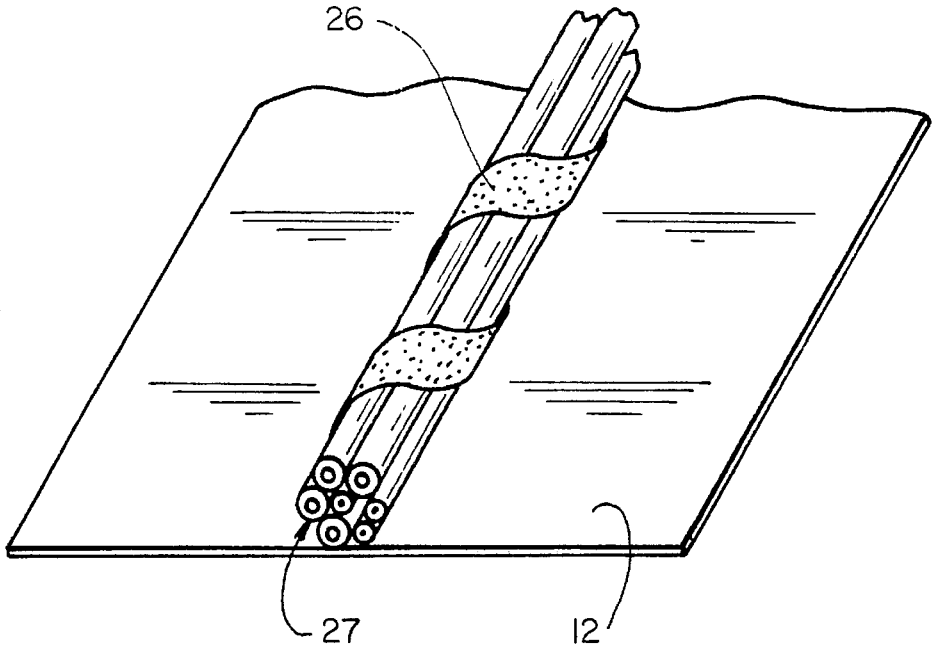
Figure 3C:
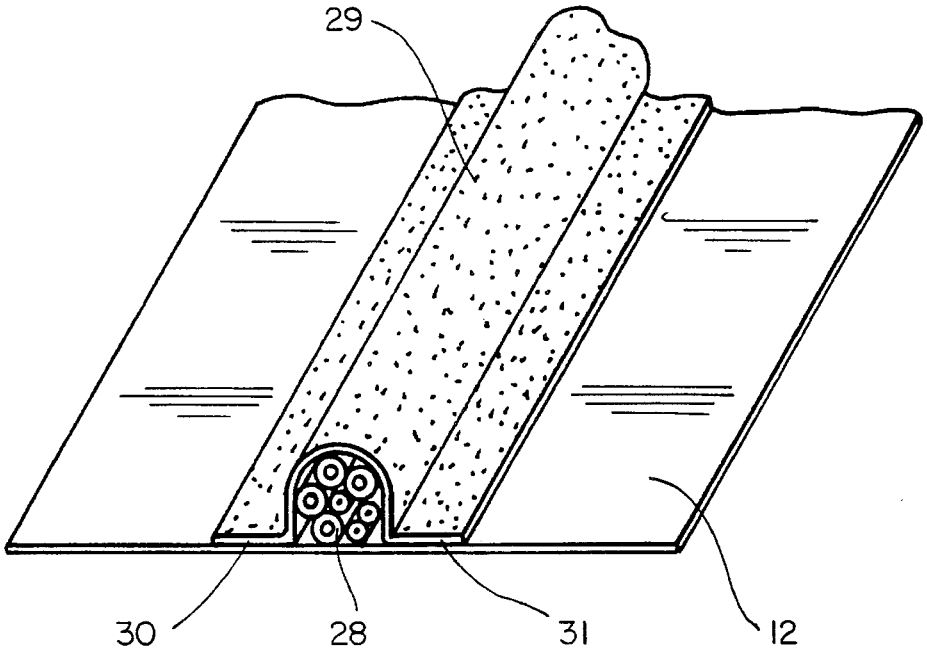

FIGS. 3*a*, 3*b* and 3*c* show various ways in which flexible affixment means may be wrapped around a cable component such as an insulated conductor or multi-conductor cable. In FIG. 3*a*, flexible affixment means 22, comprising a polymeric film, is wrapped helically in overlapping relation around an insulated wire, comprising a conductor 23 surrounded by a core layer 24 and a jacket 25, in which the jacket manifests a low surface energy, to form a affixment means which itself is secured to a carrier (support substrate) film 12. FIG. 3*b* shows flexible affixment means 26 comprising a polymeric film spirally wrapped as consecutive turns separated from one another around a bundle of insulated conductors 27. The flexible affixment means is itself secured to support substrate film 12. In FIG. 3*c*, strips of flexible affixment means 29 are wrapped over a bundle of insulated conductors 28 and secured either side of the bundle to the support substrate 12 at 30 and 31.

Figure 4:
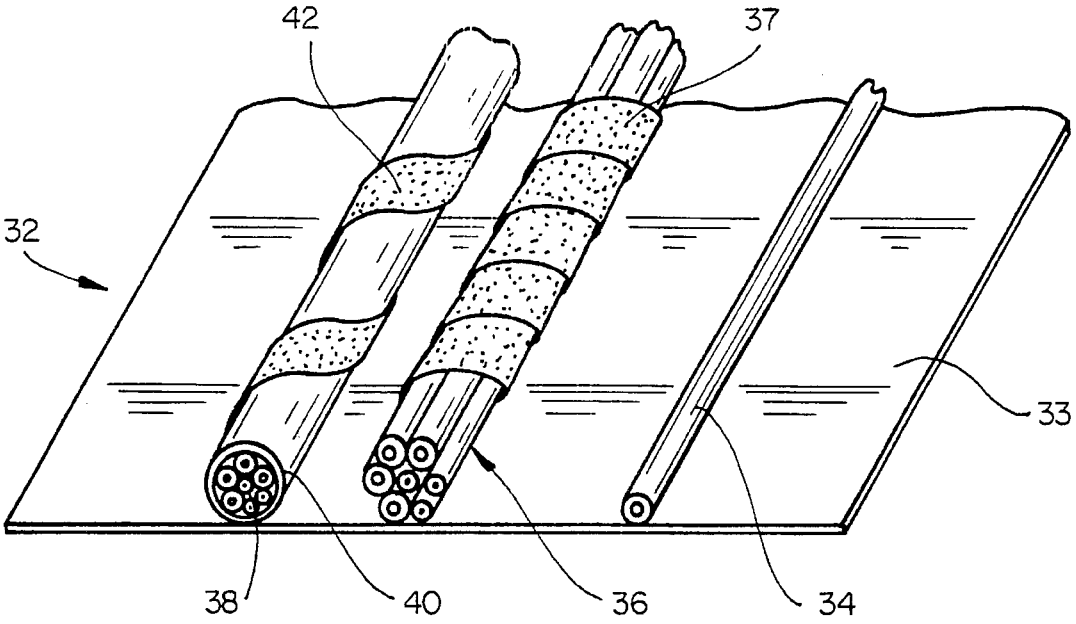
FIG. 4 is a cross section of a multi-component cable assembly of this invention in which a number of different types of conductors and/or cables are bonded to the support substrate.

FIG. 4 illustrates a flat multi-component cable assembly 32 comprising carrier (support substrate) film 33 which carries an insulated wire 34, bundles of wires 36 helically wrapped in overlapping relation by flexible affixment means 37 and a group of insulated wires of various sizes 38 surrounded by a jacket 40 which in turn is wrapped in a flexible affixment means 42 in which consecutive turns are separate from one another.

Figure 5A:
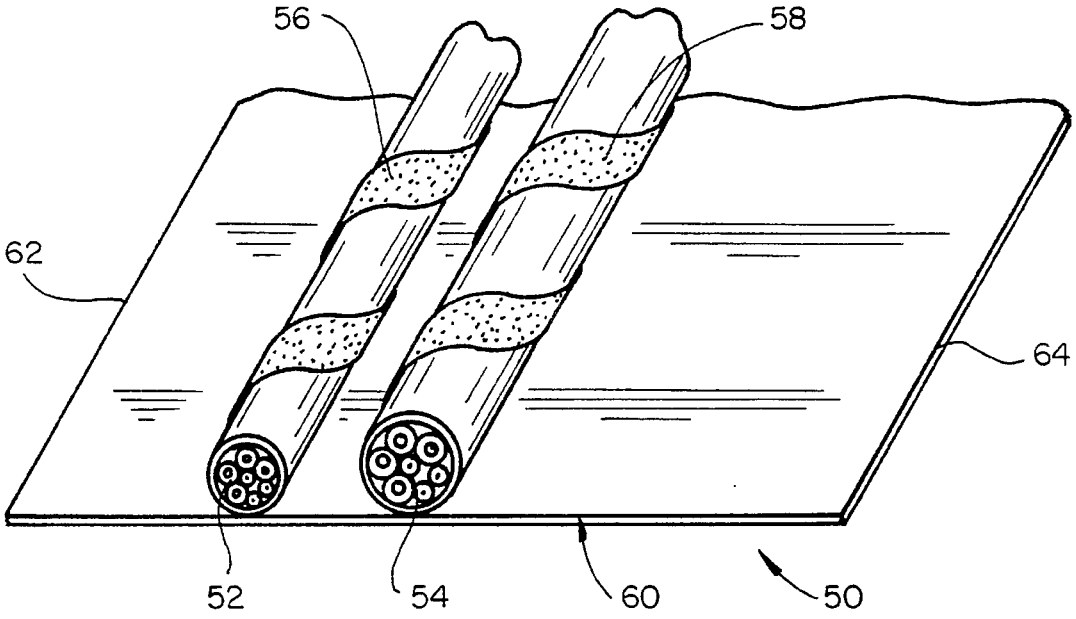
FIGS. 5*a*, 5*b* and 5*c* illustrate how a first end region and a second end region of a support substrate which end regions both extend transversely beyond cable components attached to the support substrate may be brought together and sealed together to form a tubular cover for the cable components.
Figure 5B:
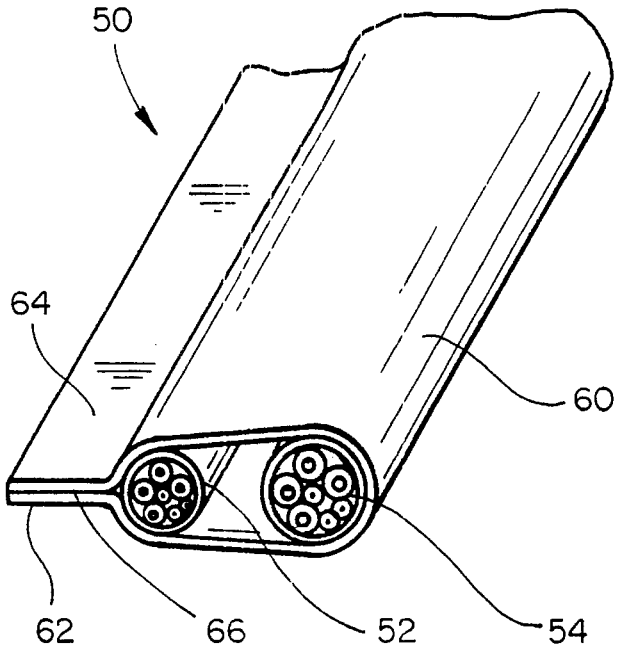
Figure 5C:
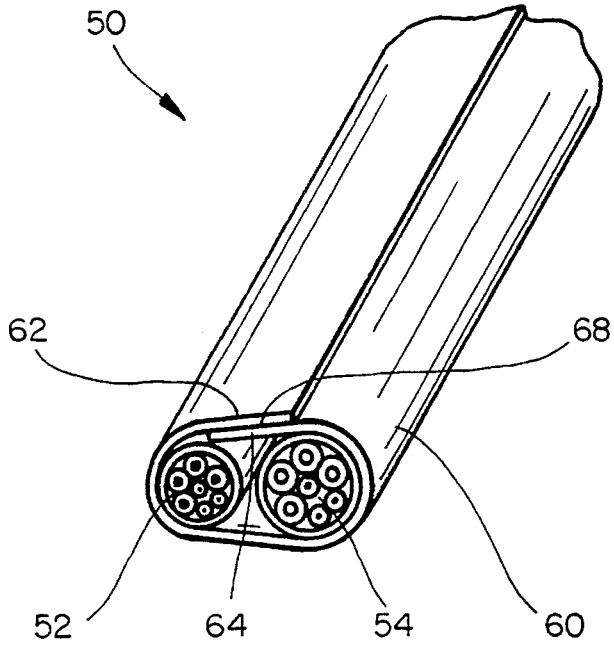

FIG. 5*a* illustrates a flat multi-component cable assembly 50 comprising cable bundle 52, which has flexible affixment means 56 spirally wrapped around it and cable bundle 54, which has flexible affixment means 58 spirally wrapped around it. In each case consecutive turns of the spiral wraps are spatially separated from one another. The cable bundles are secured in substantially parallel relation to one another along the long axis of a support substrate film 60. The flexible affixment means 56 and 58 are secured by melt bonding to the support substrate film 60, which has a first edge region 62 and a second edge region 64 of a short dimension (transverse to the long axis of the components) extending sufficiently beyond the cable bundles that the edges may be brought around and over the cable bundles as shown in FIG. 5*b* and secured together 66 to form an edge sealed tubular cover for the cable assembly or sealed together 68, as shown in FIG. 5*c*, to form an overlapped tubular cover. In embodiments of this type, which may contain more than two cable components such as insulated conductors and or cable bundles, if the tubular cover is flattened to form first and second interior facing surfaces, the cable components are advantageously attached to the same surface and thus may, if desired be located quite close to one another as is also shown in FIG. 5*c*.

Figure 6A:
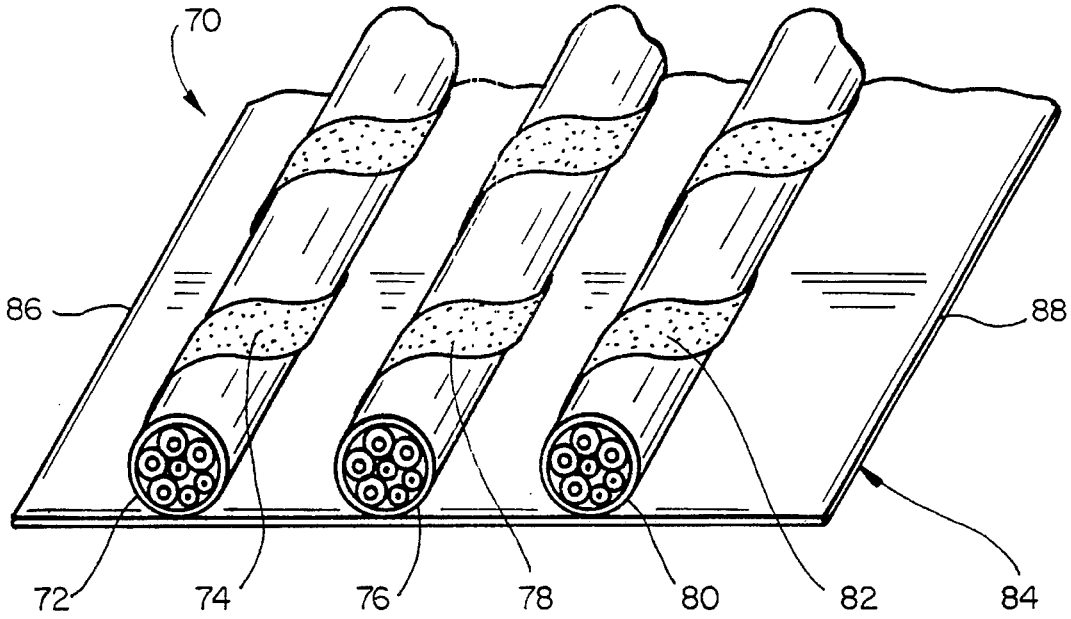
FIGS. 6*a*, 6*b* and 6*c* illustrate how a first end region and a second edge region of a carrier support substrate film extending transversely beyond at least three attached multiconductor cable components may be brought together to form a tubular cover which, if flattened, carries a first and second cable component secured to a lower surface of the tubular cover and a third cable component secured to an upper surface of the tubular cover.
Figure 6B:
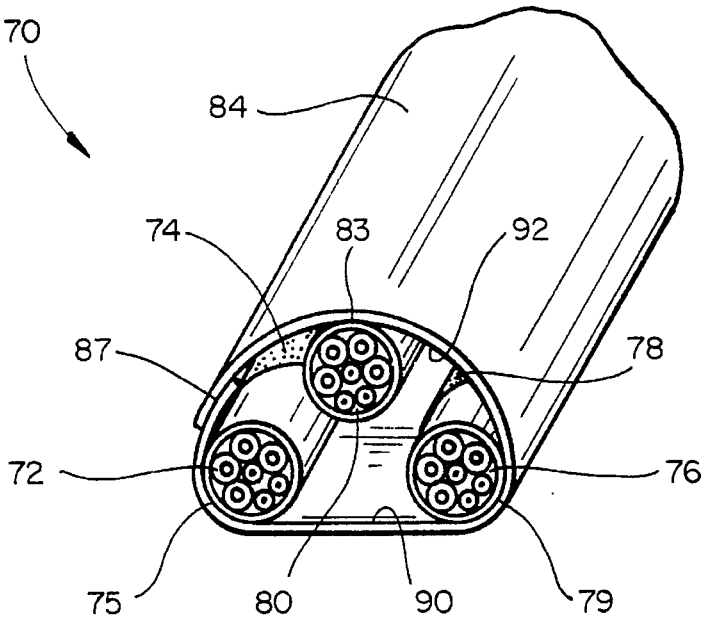
Figure 6C:
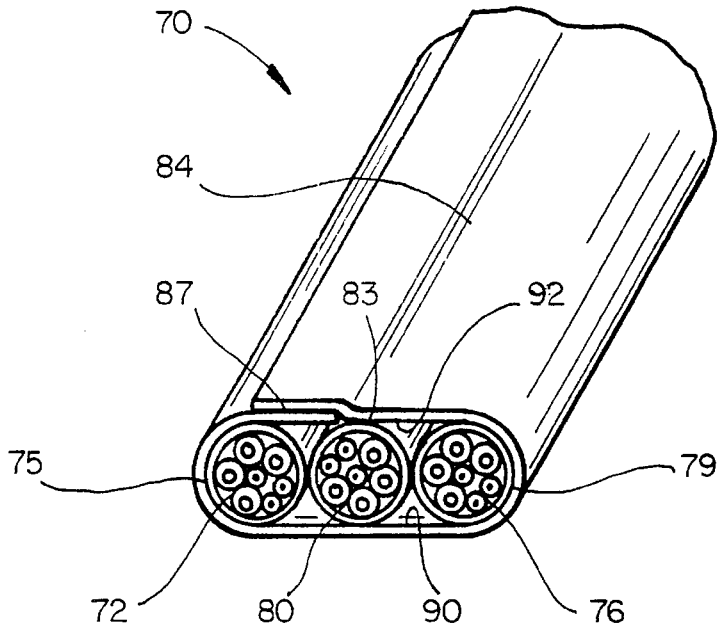

FIG. 6*a* illustrates a flat multi-component cable assembly 70 comprising a first cable bundle 72, which has flexible affixment means 74 spirally wrapped around it, a second cable bundle 76, which has flexible affixment means 78 spirally wrapped around it and a third cable bundle 80, which has flexible affixment means 82 spirally wrapped around it. In each case consecutive turns of the spiral wraps are spatially separated from one another. The cable bundles are secured in substantially parallel relation to one another along the long axis of a support substrate film 84 by bonding the flexible affixments means 74, 78 and 82 to the carrier film 84. The support substrate film has a first edge region 86 and a second edge region 88 of its short (transverse) dimension extending sufficiently beyond the cable bundles, which are located at a sufficient distance transversely from each other that the support substrate can be folded along its long axis around the first and second cable bundles so that the first and second edge regions may be brought together as shown in FIG. 6*b* and secured together 87 to form a tubular cover for the cable assembly in which the tubular cover has a first interior surface 90 opposed to a second interior surface 92. As shown in FIG. 6*c*, if the tubular cover is flattened so that it has a first interior surface 90 opposing a second interior surface 92 then the first cable bundle 72 and the second cable bundle 76 are secured through their corresponding flexible affixment means 74 and 78 (illustrated in FIG. 6*b*) to the first interior surface 90 of the tubular cover at 75 and 79 and the third cable bundle 80 is secured through its flexible affixment means 82 to the second interior surface 92 of the tubular cover at 83 such that the third cable bundle is positioned between the first and second cable bundles (illustrated in both FIG. 6*b* and FIG. 6*c*). If the assembly thus formed is twisted or bent it will be found that the construction naturally and readily assumes other configurations in which the cable bundles manifest a triangular relation to one another along the long axis of the assembly, thereby enabling the assembly to be easily and sharply bent and twisted to conform to convoluted or confined cable trays or ducts such as are frequently found in commercial and other aircraft. In embodiments of this type, in order that the construction may assume these various flattened configurations, it is necessary that a sufficient space exist between a first cable component and a second neighboring cable component both attached to a first interior surface of the tubular cover that a third cable component attached to the second interior surface of the tubular cover may be capable of at least partly interdigitating between the first and second cable components.

Figure 7:
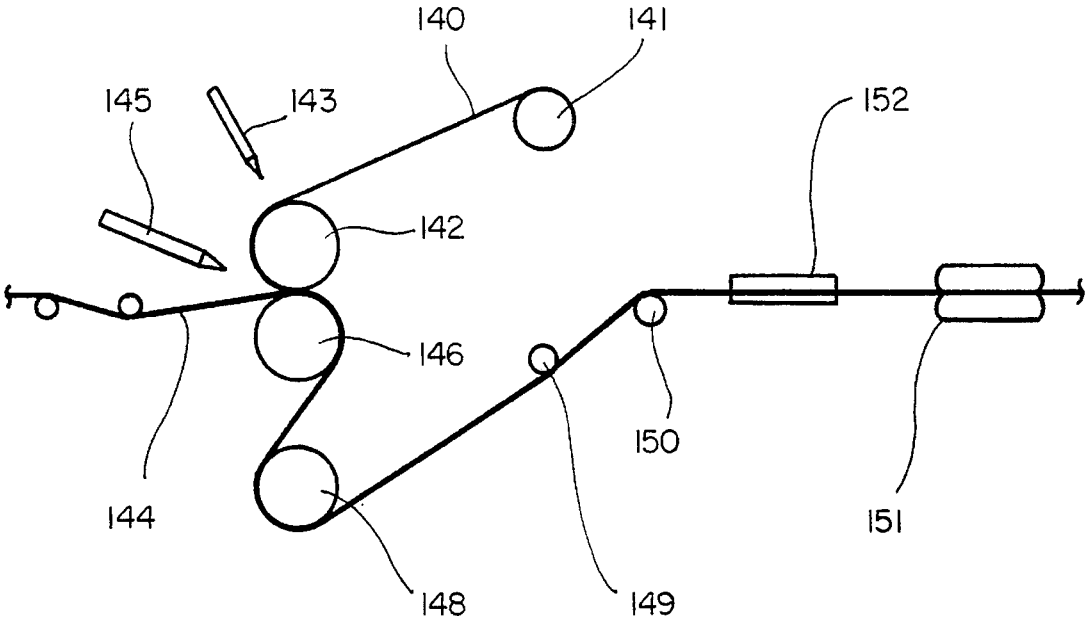
FIG. 7 illustrates a method for the manufacture of the multi-component cable assembly of this invention.

FIG. 7 shows a apparatus for the manufacture of multi-component cable assemblies of the invention. The cable components which are to be secured to the backing with affixment means are first wrapped with the affixment means using conventional spiral or other forms of wrapping equipment. The cable components 144 include at least one component which has been wrapped with flexible affixment means. The support substrate 140 is paid off from a spool 141 wound around roller 142, where it is heated to a temperature sufficient to obtain the desired bond with a hot air blower 143. It is then brought in contact with the cable components which are arranged horizontally in a single layer 144. The cable components are also heated by a hot air blower 145. The bonding is achieved between the support substrate and the affixment means and/or cable components by passing the heated support substrate and the cable components between rollers 142 and 146 with an applied pressure of approximately 20 psi. The laminated cable assembly is then wound around roller 148, and through a set of wire guides 149 and 150 to the caterpillar take up 151. If desired, excess material on both sides forming first and second end regions may be brought around the bonded cable components, and heat sealed together with an in-line wrapping and sealing unit 152. Although FIG. 7 shows the final stages of wrapping the support substrate around the cable components and then securing the first edge region of the support substrate to the second edge region thereof, it is to be understood that these steps, if desired could be carried out as a separate operation from the steps of providing the cable components, wrapping selected cable components in flexible affixment means, and securing flexible affixment means to support substrate. Separating these later steps of the method of the invention from the above mentioned other steps has the advantage that such other steps may also be used for providing products of the invention secured to support substrates which are not intended to be formed into tubular covers for cable components without having to remove the equipment used in forming such covers.

In further embodiments of the invention, the conductor may comprise an optical fiber surrounded with a layer of polymeric material (typically the jacket of a fiber optic cable). Thus, the term conductor is used herein to encompass a variety of possible arrangements of electrical conductors as well as optical fiber cables or individual optical fibers surrounded with a protective polymeric material. For the sake of convenience, the term insulated conductor is used herein to refer to any conductor or conductor arrangement surrounded by a layer of polymeric material.

Polymeric material used as insulation for conductors in the invention may comprise one or more layers independantly selected from polymers and copolymers of ethylene such as low density, high density and linear low density polyethylenes, ethylene-vinyl acetate or ethylene-propylene copolymers; polymers and copolymers of vinylidene fluoride such as polyvinylidene fluoride or vinylidene fluoride-hexafluoropropylene copolymers (including terpolymers); polymers and copolymers of tetrafluoroethylene such as poly(tetrafluoro-ethylene) and ethylene-tetrfluoroethylene copolymer (including terpolymers); siloxanes; ethylen-etrichlorofluoroethylene copolymers, polyamides, in particular, aromatic polyamides, polyimides, polyarylene ethers and the like. The polymeric material may be crosslinked if desired to provide improved properties, particularly at elevated temperatures.

Suitable materials for use as affixment means include polymers and copolymers of vinylidene fluoride such as polyvinylidene fluoride or vinylidene fluoride-hexafluoropropylene copolymers (including terpolymers); polymers and copolymers of tetrafluoroethylene such as poly(tetrafluoroethylene) and ethylene-tetrfluoroethylene copolymer (including terpolymers); siloxanes; ethylene-trichlorofluoroethylene copolymers, polyamides, in particular, aromatic polyamides, polyimides, polyesters such as polyethylene terephthalate or polybutylene terephthalate, polyarylene ethers and the like.

Suitable materials for use as the carrier backing film include polymers and copolymers of vinylidene fluoride such as polyvinylidene fluoride or vinylidene fluoride-hexafluoropropylene copolymers (including terpolymers); polymers and copolymers of tetrafluoroethylene such as poly(tetrafluoroethylene) and ethylene-tetrfluoroethylene copolymer (including terpolymers); siloxanes; ethylene-trichlorofluoroethylene copolymers, polyamides, in particular, aromatic polyamides, polyimides, polyesters such as polyethylene terephthalate or polybutylene terephthalate, polyarylene ethers and the like.

The cable components may comprise single insulated conductors; coaxial shielded single or multi conductors, foil wrapped, braided or extrusion jacketed; insulated conductor wire bundles comprising from 2 to 100 conductors; bundles of mixed single and multi conductor components and the like. The bundles may if desired be extrusion coated with jackets. However extruded jackets do not function satisfactorily as flexible jacketing means of the invention and as the flexible jacketing means and especially the tubular covers of the invention formed from the carrier films function to provide very good mechanical protection for the cable components, in many circumstances, such extruded jackets are unnecessary.

Summarizing the advantages of the multi-component cable assemblies of the invention, they provide:

1. Lower weight since a thin tape is substituted for the extruded cable jacket;

2. A higher degree of flexibility because of the lower contribution of the tape (compared to an extruded jacket) to the overall stiffness;

3. The ability to accommodate lateral bends (bends in the plane of the film) for easier installation in tight spaces;

4. Easier access to components of the individual cables for repair.

In addition, because of the simplicity of these constructions, they are often less expensive to manufacture.

EXAMPLE 1

The components for the flat cable of this example are 3 sets of cables, each containing 10 MILW 81044/12-26 wires twisted together and spiral wrapped with 3 mils thick and 0.25 inch wide Kynarflex® 2800 tape. The spacing between the spirals of the wrapped tape is 0.25 inch. The bonding substrate is a woven Dacron® polyester fabric, having a weight of 1.25 oz. per square yard, a denier of 10 and a 72/50 count with 400 micron openings. This fabric was impregnated with a Kynarflex® 2800 emulsion producing a total fabric weight of 3.6 oz. per square yard, and a thickness of 4 mils. The fabric was cut to a width of 4 inches. The bonding operation was carried out in equipment similar to that shown in FIG. 7, using the following procedure. The coated fabric 140 was paid off from a spool 141 and wound around roller 142, where it was heated to the melting temperature of the impregnant with a hot air blower 143. It was then brought in contact with the 3 sets of wrapped cables which are arranged horizontally in a single layer 144. The wrapped cables were also heated by a hot air blower 145. The bonding was achieved between the impregnant in the coated fabric and the wrapping tape by passing the heated fabric and the wrapped cables between rollers 142 and 146 with an applied pressure of approximately 20 psi. The laminated cable assembly was then wound around roller 148, and through a set of wire guides 149 and 150 to the caterpillar take up 151. Excess fabric on both sides formed first and second end regions which were brought around the bonded cables, and heat sealed together with an in-line wrapping and sealing unit 152.

EXAMPLE 2

Example 1 is repeated using as the wrapping tape and the bonding substrate a 1 mil polyethylene film pre-laminated to a 1 mil polyester film support layer. The polyethylene side of the laminated film faced outwards after being spirally wrapped around the cables. The bonding operation is carried out using the procedure and equipment as described in Example 1 with the polyethylene layer of the spiral wrap being fused to the polyethylene layer of the bonding substrate. Excess bonding substrate on both sides formed first and second end regions which were brought around the bonded cables, and heat sealed together with a hot melt polyester based adhesive in an in-line wrapping and sealing unit.

EXAMPLE 3

The components for the flat cable of this example are 5 sets of primary wires Mil-W-22759/32-22 and 3 sets of multi-conductor cables, each containing 20 Mil-W-22759/32-26 wires twisted together. Each set of the multi-conductor cables is spiral wrapped with a 2 mil Tefzel® 280 tape. The spirals are 50 percent overlapped. The bonding substrate is a plain weave fiber glass fabric, having a weight of 1.45 oz. per square yard. This glass fabric was impregnated with a Tefzel® 280 emulsion producing a total fabric weight of 2 oz per square yard, and a thickness of 3 mils. The bonding operation is carried out using the procedure and equipment described in Example 1 with the glass fabric being fused to the Tefzel® wrappings of the multi-conductor cables and to the jackets of the primary wires. Excess glass fabric on both sides of the bonded cables is trimmed off by an in-line slitter.

EXAMPLE 4

Example 3 is repeated with the multi-conductor cables and primary wires pre-arranged in such a way that when the excess glass fabric on both side of the bonded cables was brought around to be heat sealed in an inline wrapping and sealing unit thereby forming a tubular cover for the multi-component cable assembly such that some of the multi-conductor cables and primary wires were bonded to the bottom and some to the top of the tubular cover. The finished multi-component cable assembly can be reversibily deformed into a tubular configuration enabling the assembly to be bent during installation in tight spaces.

While the invention has been described herein in accordance with certain preferred embodiments thereof, many modifications and changes will be apparent to those skilled in the art. Accordingly, it is intended by the appended claims to cover all such modifications and changes as fall within the true spirit and scope of the invention.

What is claimed is:

1. A cable assembly which can be bent or twisted and which comprises (1) a support substrate;

(2) a first cable component which comprises at least one conductor; and (3) a first affixment means which (a) is wrapped spirally around the first cable component so that the first cable component is slidable relative to the first affixment means, and (b) is secured to the support substrate.

2. A cable assembly according to claim 1 wherein the support substrate is in the form of a film having edge regions which are secured together to form a tubular cover which covers the cable component and the first affixment means.

3. A cable assembly according to claim 2 containing the first affixment means which is spirally wrapped around the first cable component and a second affixment means which is spirally wrapped around a second cable component.

4. A cable assembly according to claim 3 wherein the tubular cover comprises a first major interior surface to which the first affixment means is secured and a second major interior surface which is opposed to the first major interior surface and to which the second affixment means is secured.

5. A cable assembly according to claim 3 wherein the tubular cover comprises a first major interior surface to which the first and second affixment means are secured and a second major interior surface which is opposed to the first major surface and to which no affixment means is secured.

6. A cable assembly according to claim 1 wherein the first cable component comprises a plurality of metal conductors each surrounded by a layer of polymeric insulation.

7. A cable assembly according to claim 1 wherein the first cable component comprises an optical fiber.

8. A cable assembly according to claim 1 wherein the support substrate is a polymeric film.

9. A cable assembly according to claim 1 wherein the support substrate is a fabric.

10. A cable assembly according to claim 1 wherein the first affixment means is a polymeric film.

11. A cable assembly according to claim 10 wherein consecutive wraps of the film around the first cable component overlap.

12. A cable assembly according to claim 10 wherein consecutive wraps of the film around the first cable component are spaced apart.

13. A cable assembly according to claim 10 wherein the polymeric film is melt bonded to the support substrate.

14. A cable assembly according to claim 1 which further comprises at least one insulated metal conductor which is secured to the support substrate.

15. A cable assembly according to claim 2 which further comprises an insulated metal conductor which is enclosed within the tubular cover and is not wrapped by the first affixment means.

16. A cable assembly which comprises (1) a support substrate;

(2) a first cable component which comprises a plurality of insulated metal conductors; and (3) a first affixment means which (a) is in the form of a polymeric film wrapped spirally around the first cable component so that the first cable component is slidable relative to the first affixment means, and (b) is secured to the support substrate.

17. A cable assembly according to claim 16 wherein the first affixment means is melt bonded to the support substrate.

18. A cable assembly according to claim 16 wherein consecutive wraps of the film around the first cable component overlap.

19. A cable assembly according to claim 16 wherein consecutive wraps of the film around the first cable component are spaced apart.

20. A cable assembly according to claim 16 which contains the first cable component spirally wrapped by the first affixment means and a second cable component spirally wrapped by a second affixment means.

21. A cable assembly according to claim 16 wherein the support substrate is a polymeric film.

22. A cable assembly according to claim 16 wherein the support substrate is a fabric.

23. A cable assembly according to claim 16 wherein the substrate is in the form of a film having edge regions which are secured together to form a tubular cover which covers the first cable component and the first affixment means.

24. A cable assembly according to claim 23 which further comprises an insulated metal conductor which is enclosed within the cover and is not wrapped by the first affixment means.

* * * * *